United States Patent [19]

Tully

[11] 4,042,354

[45] Aug. 16, 1977

[54] ELECTROSTATIC PRECIPITATOR HAVING AN IMPROVED DISCHARGE AND COLLECTOR ELECTRODE SYSTEM AND GAS DISTRIBUTION MEANS

[75] Inventor: William Howard Tully, Cockeysville, Md.

[73] Assignee: Environmental Elements Corporation, Baltimore, Md.

[21] Appl. No.: 582,393

[22] Filed: May 30, 1975

Related U.S. Application Data

[63] Continuation-in-part of Ser. No. 440,132, Feb. 5, 1974, abandoned.

[51] Int. Cl.[2] ..... B03C 3/40

[52] U.S. Cl. ..... 55/129; 55/140; 55/148; 55/152; 55/435; 55/DIG. 38

[58] Field of Search ..... 55/101, 124, 126, 128, 55/129, 140, 146, 147, 148, 150, 152, 153, 154, 157, 108, 117, 344, 418, 435, DIG. 38

[56] References Cited

U.S. PATENT DOCUMENTS

| | | | |
|---|---|---|---|
| 1,252,183 | 1/1928 | Schmidt et al. | 55/150 X |
| 1,372,710 | 3/1921 | Nesbit et al. | 55/126 X |
| 1,634,372 | 7/1927 | Lewers | 55/148 |
| 1,971,855 | 8/1934 | Heimrod | 55/147 X |
| 1,997,729 | 4/1935 | Herber | 55/140 X |
| 2,100,155 | 11/1937 | Beran | 55/108 X |
| 2,708,007 | 5/1955 | Vickland | 55/146 X |
| 3,483,678 | 12/1969 | Burdock et al. | 55/418 X |
| 3,495,379 | 2/1970 | Hall et al. | 55/146 X |
| 3,653,186 | 4/1972 | McLendon | 55/435 X |
| 3,750,373 | 8/1973 | Olson | 55/146 |
| 3,819,985 | 6/1974 | Dusevoir | 55/146 X |
| 3,831,351 | 8/1974 | Gibbs et al. | 55/147 |
| 3,831,354 | 8/1974 | Bakke | 55/418 |

FOREIGN PATENT DOCUMENTS

| | | | |
|---|---|---|---|
| 1,074,075 | 10/1954 | France | 55/128 |
| 428,471 | 11/1934 | United Kingdom | 55/140 |
| 387,452 | 2/1933 | United Kingdom | 55/129 |
| 968,065 | 8/1964 | United Kingdom | 55/150 |

*Primary Examiner*—Frank W. Lutter
*Assistant Examiner*—David L. Lacey
*Attorney, Agent, or Firm*—Herbert J. Zeh, Jr.; Oscar B. Brumback

[57] ABSTRACT

Herein disclosed is an electrostatic precipitator for removal of corrosive particles from a corrosive laden gas passing therethrough. The electrostatic precipitator comprises a shell having a corrosive resistant lining secured thereto. A corrosive resistant support plate is secured to the shell of the precipitator and first and second sets of juxtaposed corrosive resistant collector electrode tubes are suspended from the support plate. A corrosive resistant top support grid is spaced above the support plate and insulated from the shell and a corrosive resistant bottom guide grid is spaced below the first and second sets of collector electrode tubes. A plurality of corrosive resistant discharge wires are secured between the top support grid and the bottom guide grid and pass substantially through the center of the tubes in the first set. A plurality of corrosive resistant discharge support members are secured between the top support grid and the bottom guide grid and pass substantially through the center of the tubes in the second set for supporting the bottom grid. Inlet port means extend through the shell above the bottom of the first and second sets of collector electrode tubes for supplying the corrosive particle laden gas to the interior of the precipitator and for insuring a substantially even distribution of the gas throughout the interior of the precipitator below the support plate prior to the gas entering the bottom of the first and second sets of collector electrode tubes for removal of the corrosive particles.

6 Claims, 9 Drawing Figures

FIG. 3
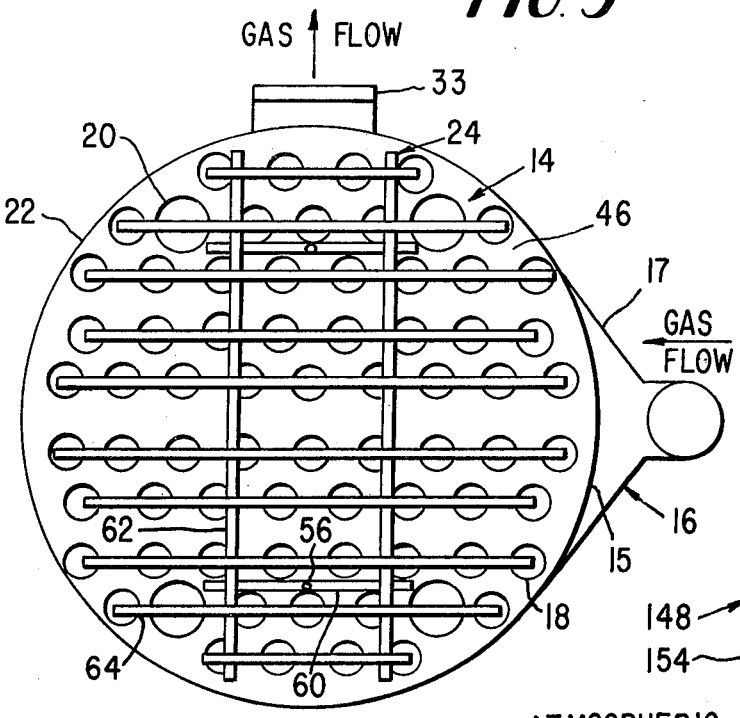
FIG. 9
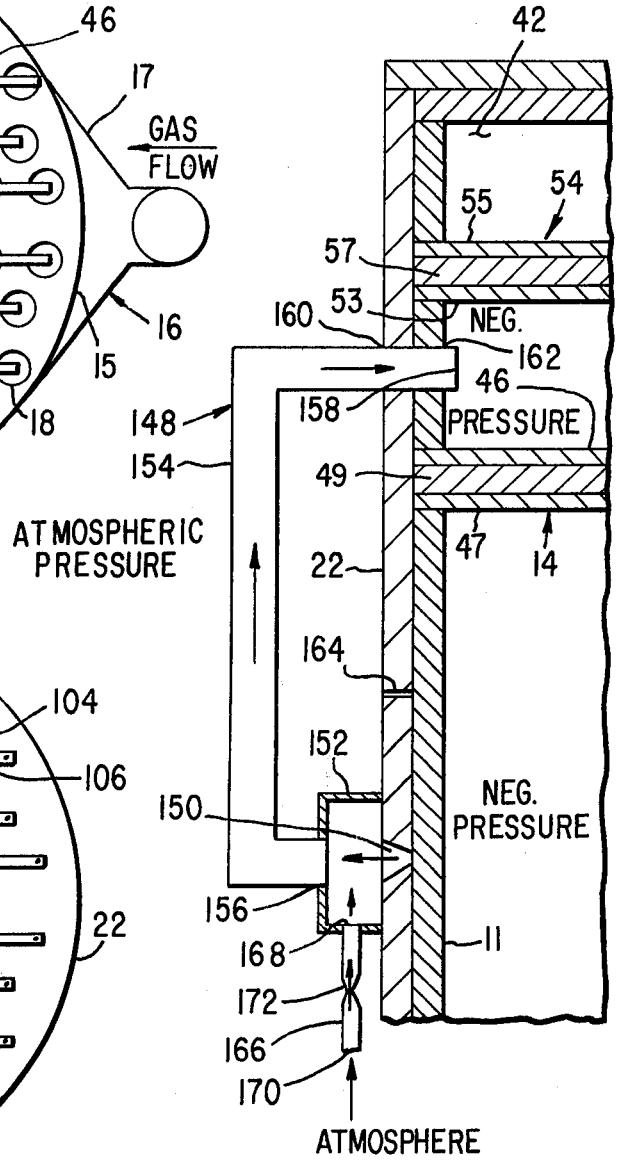
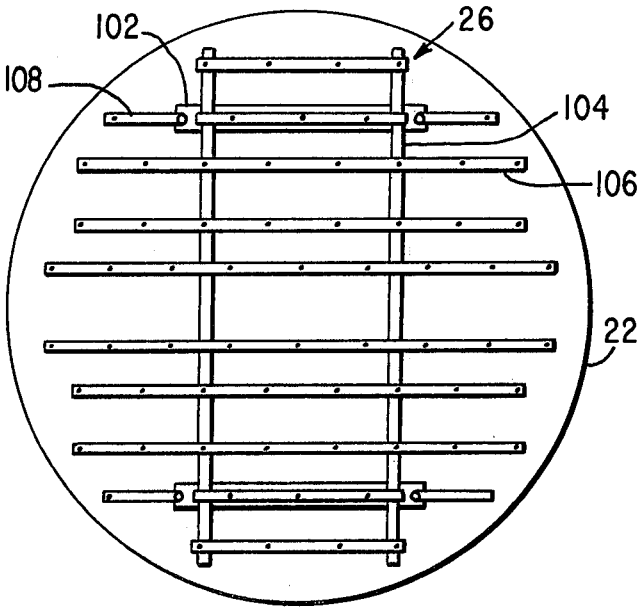
FIG. 4

FIG. 5
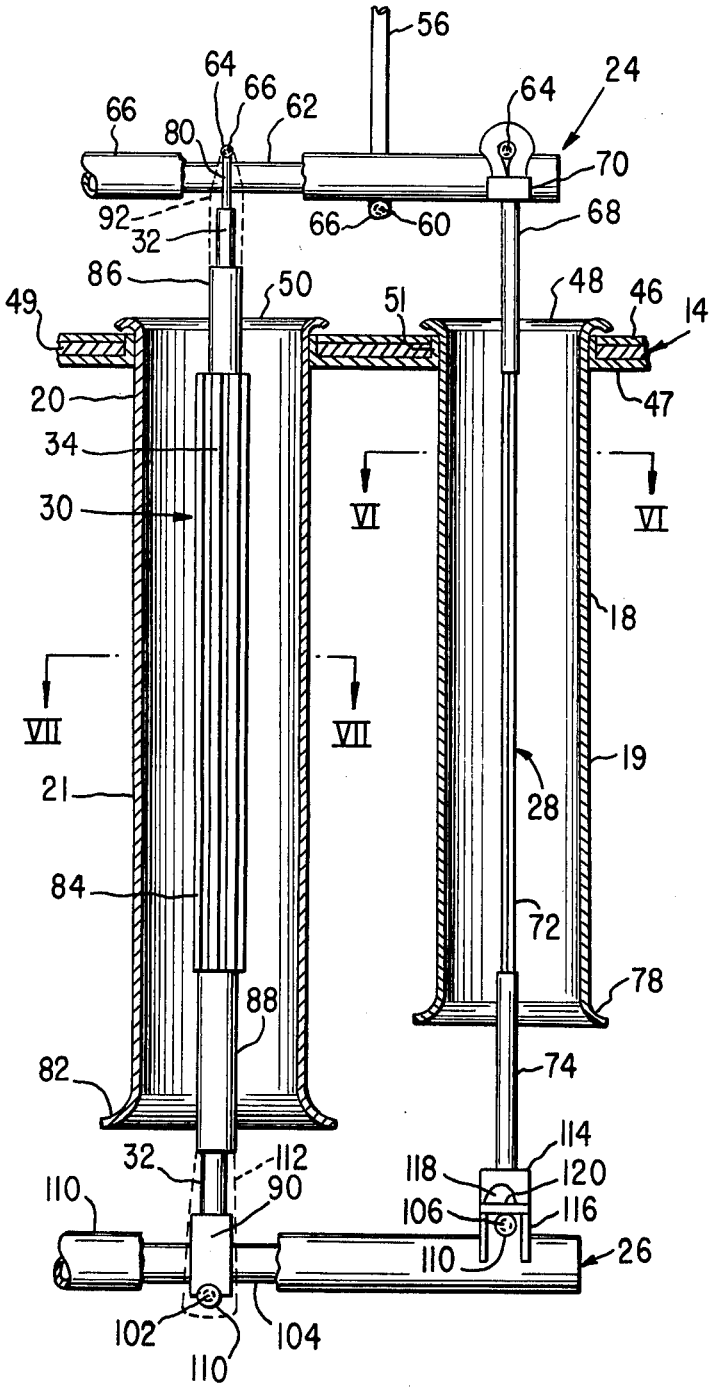
FIG. 6
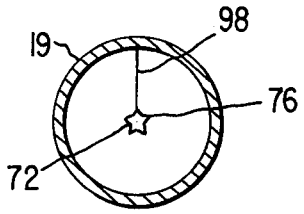
FIG. 7
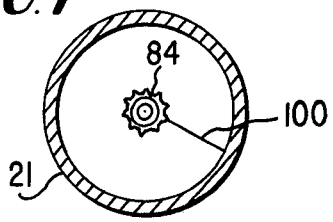
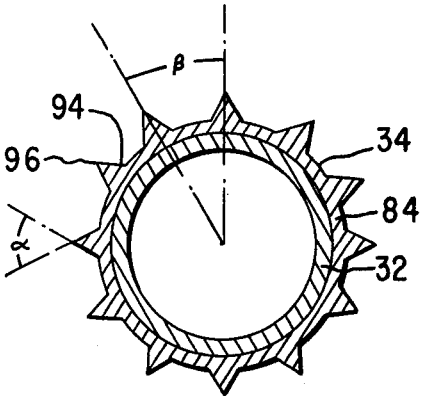
FIG. 8

ELECTROSTATIC PRECIPITATOR HAVING AN IMPROVED DISCHARGE AND COLLECTOR ELECTRODE SYSTEM AND GAS DISTRIBUTION MEANS

CROSS REFERENCE TO RELATED APPLICATIONS

This application is a continuation-in-part of application Ser. No. 440,132 filed Feb. 5, 1974, entitled "Discharge and Collector Electrode System for Electrostatic Precipitators," inventor Mr. William Howard Tully, and assigned to the assignee of the present invention, now abandoned.

BACKGROUND OF THE INVENTION

1. Field of the Invention

This invention relates generally to gas separation by electrostatic precipitators having electrode retaining supporting means and more particularly to electrostatic precipitators that remove corrosive particles from a corrosive particle laden gas passing therethrough having improved discharge and collector electrode system and gas distribution means.

2. Description of the Prior Art

Industry generally utilizes two types of electrostatic precipitators for purifying industrial gases prior to the gases being released to the atmosphere. One such type of electrostatic precipitator utilizes the plurality of spaced collector electrode plates suspended within the precipitator with a plurality of discharge electrode wires suspended between adjacent plates. This type of precipitator is used to remove particles from a gas that is essentially non-acidic. The second type of precipitator utilizes a plurality of acid resistant collector electrode tubes suspended within the precipitator. Each tube has a single acid resistant discharge wire suspended through its center. This invention is limited to improvements designed to enhance the efficiency of the second type precipitator. When a corrosive particle laden gas is passed through the collector electrode tube of this second type precipitator, a voltage is applied to the discharge wires running through the center of each of the collector electrode tubes, causing an electrostatic field to be created within the collector electrode tubes. When the electrostatic field has been created, it ionizes the acid particles within the gas and these charged particles are collected on the inside surface of the collector electrode tubes. The particles are disposed of by letting the wet acid particles run down the inside surface of the collector electrode tube to be collected at the bottom of the precipitator for disposal.

It is a common phenomenon that when the discharge wires are electrofied, they tend to oscillate or swing due to the electrical field created. This oscillation causes a non-uniform electrical field and may cause arcing between the discharge electrode wire and the collector electrode tube when the discharge wires come in close proximity to the collector electrode tube. This arcing is detrimental to the collector electrode tube in that it produces holes therein and results in inefficient precipitator operation.

In the tube precipitator it is common practice to suspend a rigid tubular support grid from the top of the precipitator just above the top of the collector electrode tube. The single discharge wires are suspended from the top support grid through the center of the collector electrode tubes. A weight is suspended from the bottom of each discharge wire to maintain the discharge wire straight. The stiffness of the discharge wire and the combined mass of the discharged wire and the attached weight offset the oscillating tendency described above. In addition, the lower end of the discharge wires are guided by a rigid tubular grid located below the collector electrode tubes. The guide grid is suspended from the top support grid by a plurality of rigid tubular support pipes. The grid system is covered by an anti-corrosive material such as lead to prevent the acid from damaging the grid system. In addition, the interior of the precipitator shell is lined with a lead covering to prevent acid from contacting the non-corrosive resistant metal shell. Further, the collector electrode tubes and discharge wires are commonly made of lead.

It is common practice to place each of the lead covered support pipes through the center of the corresponding number of collector electrode tubes to eliminate the need to insulate the supports from the shell since the support pipes are carrying high voltage electrical current and to utilize the space occupied thereby for collecting purposes thus increasing the overall efficiency of the precipitator. Standard 10 inch collector electrode tubes are used with a single discharge wire through the center and standard 13 inch diameter collector electrode tubes are used with the support pipes extending through the center thereof.

In the past, several types of support members have been used to try and enhance the electrical emission by each of the support members. First, the support pipe was fabricated from two steel angle beams welded at the apices and covered with a lead sheet to protect the angle beams from the corrosive elements. Four conventional lead star wires which are used as the standard discharge collector electrode wire were burned to the exterior surface of the lead sheet. It was found that the electrical emission efficiency from the four star wires was not satisfactory. A second type of support pipe was fabricated from a steel pipe which was covered with a lead sheet. Again, four star wires were burned to the lead sheet at substantially 90° angles. The results were better than that previously used but were not satisfactory in that they did not increase the emission efficiency of the support pipe. The third type support pipe was again a steel pipe covered with a lead sheet to protect it from the corrosive elements of the gas passing around it. However, eight star wires were burned to the sheet lead cover at 45° angles. The result improved the overall electrical emission efficiency of the support pipe. However, they were not entirely satisfactory and did not produce the same precipitating efficiency as the single discharge star wire in the 10 inch diameter collector electrode tube. In addition, the third type discharge support pipe creates a number of other disadvantages. It is quite time consuming and expensive to burn the desired number of discharge wires to the lead covering of the support pipe. There are usually four support pipes supporting the bottom grid guide and since there are eight discharge wires for each support pipe, it makes a total of 32 discharge wires that must be attached. Another disadvantage is that it has not been possible to substantially simulate the gap between the discharge electrode wire and the inside surface of the 10 inch diameter collector electrode tube in the 13 inch diameter collector electrode tube when using the standard pipe and lead sheet covering. The radial distance between the discharge wires burned to the lead covering of the support pipe and the inner surface of the 13 inch collector electrode tube is less than the radial distance between the single discharge wire and the inner surface of a 10 inch collector electrode tube. Thus, a lower voltage is generated in the 13 inch collector electrode tube than in the 10 inch collector electrode tube and the voltage supplied to the support pipes will control the voltage in all the collector electrode tubes causing inefficient precipitation in the 10 inch collector electrode tubes.

Another disadvantage is that although there are numerous configurations for discharge wires the most efficient is the shape of a five pointed star, commonly called star wire. The elecrical emission producing the electrostatic field from each of the points of the star is exceptionally good. But when the star wires are burned to the lead covering on the support pipe, some of the points of the stars are pointed toward the adjacent star. The electrical emissions from these points conflict causing inefficient corona and precipitation.

Another problem associated with tube type precipitators which are used for the removal of acidic particles from an acid particle laden gas is maintaining an even distribution of gas flowing through all the collector electrode tubes within the interior of the precipitator so no one collector electrode tube handles more gas than another. Conventionally, these precipitators not only include a top support plate from which the collector tubes are suspended but also include a bottom plate secured around the bottom of each collector tube and secured to the wall of the precipitator. The gas enters through the side of the precipitator below the bottom plate so that it may enter the bottom of the collector electrode tubes. However, ordinarily there is but one inlet port for directing the gas into the precipitator below the bottom plate. Since in a conventional tube type precipitator the shell is cylindrical there will be some collector electrode tubes which are in close proximity to the inlet port and there will be a majority of collector electrode tubes which are spaced farther and farther away from the inlet port. Thus, when the gas flows through the inlet port the majority of the gas rises through those collector electrode tubes which are in close proximity to the inlet port and relatively small amounts of gas enter those collector electrode tubes that are at the opposite point from the inlet port. Thus, those collector electrode tubes that are close to the inlet port will handle a vast amount of gas flowing therethrough and the precipitation of the gas will not be complete causing some gas to escape through the top of the collector electrode tubes that still contain acid particles. In addition, since relatively little gas enters those collector electrode tubes at the far point from the inlet port, they will not be working at their maximum capacity. The lack of equal distribution of gas through all the collector electrode tubes causes inefficient precipitation.

Another disadvantage associated with collector electrode precipitators that remove acid particles from an acid laden gas is that the inside surface of the shell must be lined with some type of corrosive resistant material such as lead so that the corrosive gases will not attack the non-corrosive resistant metal shell. In addition, conventionally, the interior of the precipitator above the top support plate and below the bottom plate is at a lower or negative pressure as compared to the outside atmospheric pressure. Should a pin hole develop through the shell of the precipitator, a positive pressure will be maintained between the shell and the lead lining in the interior of the precipitator. This positive pressure acting on one side of the lead lining above the top support plate and below the bottom plate will cause the lining to pull away from the metallic shell and will eventually cause the lead lining to rupture. When this happens, the precipitator must be shut down and the damaged lining repaired and the pin hole or break in the shell must be found and sealed up.

Another problem inherent in tube type precipitators that use bottom plates is that the area above the top support plate and below the bottom plate is maintained at a negative pressure compared to the outside atmospheric pressure as stated previously while the pressure between the top and bottom plates is maintained at atmospheric pressure. This results in a negative pressure within the collector electrode tubes and a positive pressure on the outside of the collector electrode tubes. The pressure differential between the outside and inside of the collector electrode tubes causes the lead collector electrode tubes to collapse inward which necessitates shutting down the precipitator to replace the collapsed collector electrode tube.

SUMMARY OF THE INVENTION

Accordingly, an object of the present invention is to provide an electrostatic precipitator for removal of acidic particles from an acid laden gas that will overcome the aforementioned disadvantages and others; thus, this invention provides a discharge electrode support means that produces a uniform electrical field at the same potential as the non-support wires, an inlet port means for insuring a substantially even distribution of the gas through the interior of the precipitator shell prior to the gas entering the bottom of the collector electrode tubes, a negative pressure throughout the entire interior of the precipitator, and a pressure relief means to insure that a continuous negative pressure is maintained between the shell and the lead covering.

This is generally accomplished by providing the electrostatic precipitator that removes corrosive particles from a corrosive particle laden gas passing therethrough with a shell having a corrosive resistant lining secured thereto; a corrosive resistant support plate secured to the shell of the precipitator; first and second sets of juxtaposed corrosive resistant collector electrode tubes suspended from the support plate; a corrosive resistant top support grid spaced above the support plate and insulated from the shell; a corrosive resistant bottom guide grid spaced below the first and second sets of collector electrode tubes; a plurality of corrosive resistant discharge wires secured between the top support grid and the bottom guide grid and passing substantially through the center of the tubes in the first set; a plurality of corrosive resistant discharge support members secured between the top support grid and the bottom guide grid and passing substantially through the center of the tubes in the second set for supporting the bottom guide grid; an inlet port means extending through the shell above the bottom of the first and second sets of collector electrode tubes for supplying the corrosive particle laden gas to the interior of the precipitator and for insuring a substantially even distribution of the gas throughout the interior of the precipitator below the support plate prior to the gas entering the bottom of the first and second sets of collector tubes for removal of the corrosive particles. In addition, the precipitator eliminates the bottom plate and includes a pressure relief means having one end connected between the shell and lining below the support plate and having the other end connected to the interior of the precipitator above the support plate for maintaining negative pressure between the shell and the lining thereby preventing atmospheric pressure between the shell and the lining from forcing the lining away from the shell.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike:

FIG. 3 is a cross sectional view of the electrostatic precipitator of FIG. 1 taken along the lines III—III and showing the different sets of collector electrode tubes, the top support grid for the discharge electrodes, and the gas inlet and gas outlet ports;

FIG. 4 is a cross sectional view of the electrostatic precipitator of FIG. 1 taken along the lines IV—IV showing the bottom guide grid for the discharge electrodes;

FIG. 5 is a partial side view in cross section of the different sets of collector electrode tubes showing the support plate, the single wire discharge electrode, the discharge electrode support member with integrally formed striae, and the connection of the discharge electrode to the top support grid and the bottom guide grid;

FIG. 6 is a cross sectional view of FIG. 5 taken along the lines VI—VI showing a collector electrode tube with a star wire discharge electrode extending through its center;

FIG. 7 is a cross sectional view of FIG. 5 taken along the lines VII—VII showing a collector electrode tube with a discharge electrode support member extending through its center;

FIG. 8 is an enlarged cross sectional view of the discharge electrode support member of FIG. 7 showing its preferred construction; and FIG. 9 is an enlarged view of a portion of the electrostatic precipitator of FIG. 1 showing a shell of the precipitator, the lead lining, and the pressure relief means for maintaining a negative pressure between the shell and the lining.

DESCRIPTION OF THE PREFERRED EMBODIMENT

Figure 1:
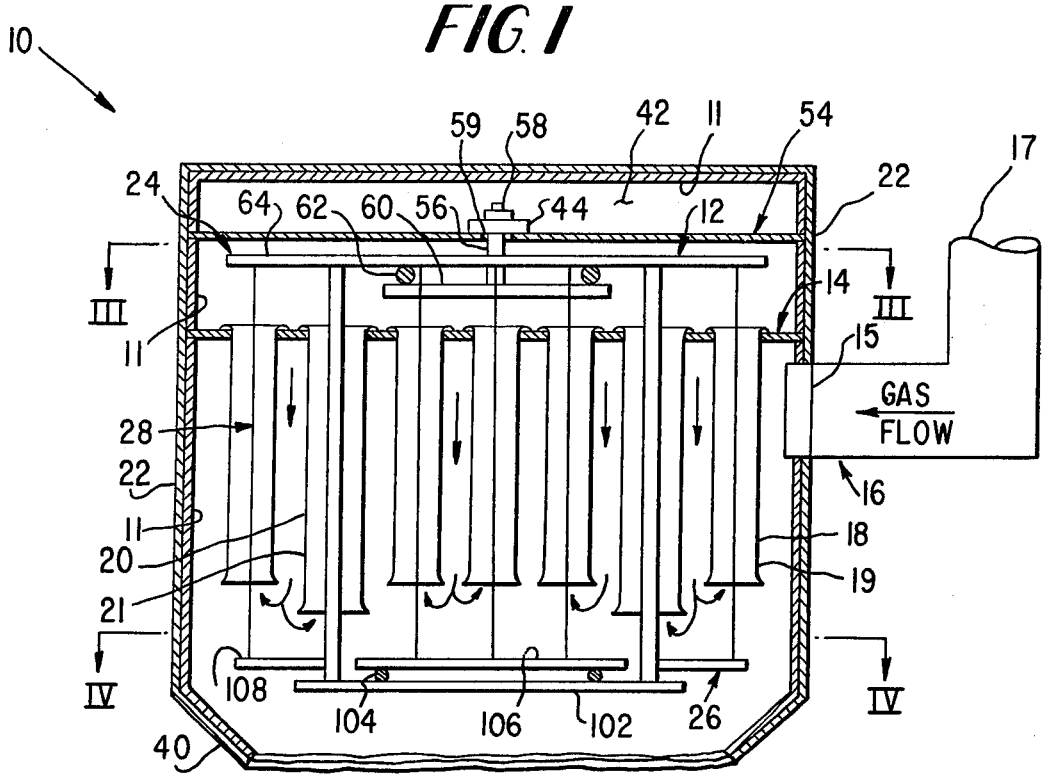
FIG. 1 is a schematic illustration in front elevation of an electrostatic precipitator of the present invention showing the discharge and collector electrode system and gas distribution means.

Referring to FIG. 1, the invention generally comprises an electrostatic precipitator, denoted generally by numeral 10, for removal of corrosive particles from a corrosive particle laden gas passing therethrough. Electrostatic precipitator 10 comprises a shell 22 having a corrosive resistant lining 11 secured thereto. A corrosive resistant support plate, denoted generally by numeral 14, is secured to shell 22 of precipitator 10. First and second sets 18 and 20 respectively, of juxtaposed corrosive resistant collector electrode tubes 19 and 21 respectively, are suspended from support plate 14. A corrosive resistant top support grid, denoted generally by numeral 24, is spaced above support plate 14 and insulated from shell 22. A corrosive resistant bottom guide grid, denoted generally by numeral 26, is spaced below first and second sets 18 and 20 of collector electrode tubes 19 and 21 respectively. A plurality of corrosive resistant discharge wires, denoted generally by numeral 28, are secured between top support grid 24 and bottom guide grid 26 and pass substantially through the center of tubes 19 in first set 18. A plurality of corrosive resistant discharge support members, denoted generally by numeral 30, are secured between top support grid 24 and bottom guide grid 26 and pass substantially through the center of collector electrode tubes 21 in second set 20 for supporting bottom grid 26. An inlet port means 16 extends through shell 22 above bottoms 78 and 82 of first and second sets 18 and 20 respectively of collector electrode tubes 19 and 21 respectively. Inlet port means 16 supplies the corrosive particle laden gas to the interior of precipitator 10 and insures a substantially even distribution of the gas throughout the interior of precipitator 10 below support plate 14 prior to the gas entering bottoms 78 and 82 of collector electrode tubes 19 and 21 respectively of first and second sets 18 and 20.

It should be emphasized that precipitator 10 of the present invention is used for removing corrosive elements such as acidic particles from a corrosive gas such as an acid particle laden gas passing therethrough and thus the interior components of precipitator 10 will be subject to corrosion by the acid particles in the gas. Thus, the interior parts of precipitator 10 that are likely to come in contact with the acid particles must be made of a non-corrosive element or covered with a non-corrosive metal such as, for example, lead.

More specifically, precipitator 10, as shown in FIGS. 1, 3, and 4, includes a shell 22 which completely encloses the internal components of precipitator 10. Shell 22 is normally made from a corrosive metal such as steel and therefore is subject to be attacked by the corrosive gas passing through the interior thereof. Thus, the inside surfaces of shell 22 must be acid resistant since the acid laden gas will contact any exposed surface within precipitator 10. Any conventional method may be used to insure that the walls of shell 22 are acid resistant such as, for example, by lining the inside walls of shell 22 with lead sheets 11 or tile. Lead sheets 11 may be secured to the walls of shell 22 by placing metal straps (not shown) over lead sheets 11 and then riviting the metal straps to the walls of shell 22. Other lead sheets 11 are placed over each strap and the lead sheets covering the metal strap are burned to lead sheet 11 covering the wall. By this means, both the metal walls of shell 22 and the metal straps are protected from being contacted by the acid laden gas.

Referring to FIG. 1, shell 22 further includes a gas inlet port 16 which extends through shell 22 and lead lining 11 between bottoms 78 and 82 of collector electrode tubes 19 and 21 respectively and support plate 14 so that the acid laden gas flows through the entire interior of precipitator 10 below support plate 14 prior to descending downward below bottoms 78 and 82 of collector electrode tubes 19 and 21 of first and second sets 18 and 20, thereby insuring even distribution of the acid laden gas through all collector electrode tubes 19 and 21 in the first and second sets 18 and 20. As shown in FIG. 1, it is preferred that inlet port 16 enter precipitator 10 through shell 22 as close to support plate 14 as possible. Thus, as the gas enters the interior of precipitator 10 through gas inlet port 16, it will expand throughout the region of precipitator 10 immediately below support plate 14 prior to descending downward. Thus, as the acid laden gas flows downward, it will expand and evenly distribute itself throughout the interior of precipitator 10 prior to descending below bottoms 78 and 82 of collector electrode tubes 19 and 21. Therefore, when the gas enters the bottoms 78 and 82 of each of the collector electrode tubes 19 and 21, in first and second sets 18 and 20, a substantially equal amount of gas flow will be maintained through each and every collector electrode tube 19 and 21. In this manner, no one collector tube 19 or 21 will carry a greater amount of acid laden gas through it than any other collector tube 19 or 21. Thus, complete precipitation of the acid particles from the acid laden gas will be substantially assured through each collector electrode tube 19 and 21, insuring that the gas rising from the tops of collector electrode tubes 19 and 21 will be substantially free of any acid particles.

Referring to FIGS. 1 and 3 inlet port means 16 includes an opening 15 extending through shell 22 and lining 11 at a point below and substantially close to support plate 14. The acid laden gas is brought to gas opening 15 by any conventional means such as by an acid resistant conduit 17 or duct work. Acid resistant conduit 17 is secured to shell 22 overlapping opening 15 such as by welding.

Figure 2:
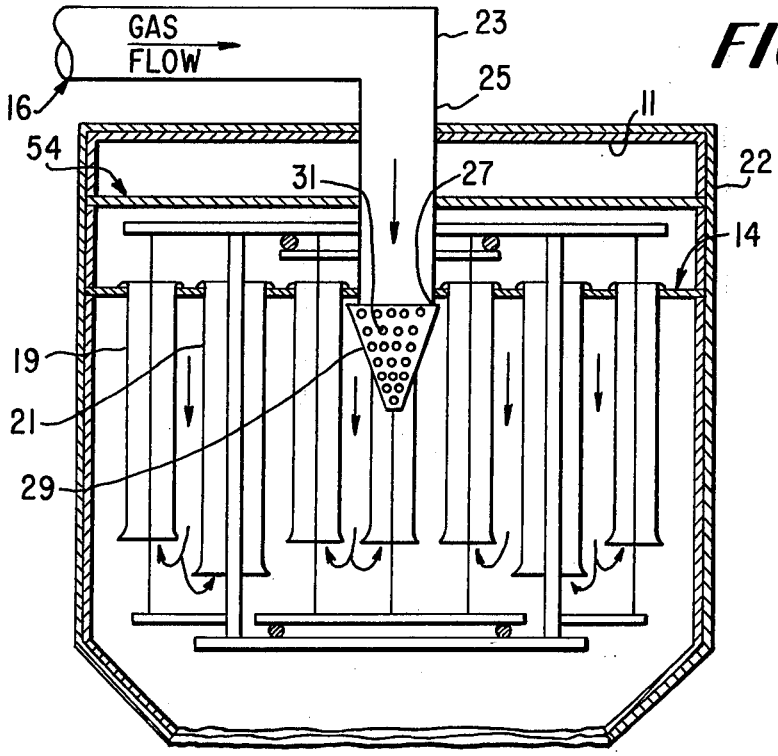
FIG. 2 is a schematic illustration in front elevation of an electrostatic precipitator of the present invention showing an alternate embodiment to the gas distribution means.

Referring now to FIG. 2 which shows the alternate embodiment for inlet port 16 for evenly distributing the acid laden gas throughout the interior of precipitator 10 prior to entering the bottoms 78 and 82 of the collector electrode tubes 19 and 21, a conduit 23 made from an acid resistant material extends through the top of precipitator 10 and into the interior thereof. Conduit 23 extends through shell 22 and lining 11 from the top of precipitator 10, extends through acid resistant plate 54, and through support plate 14. Thus, one end 25 of conduit 23 extends above the top of precipitator 10 while the other end 27 of conduit 23 extends into the interior of precipitator 10 below support plate 14. Conduit 23 is secured to the top of precipitator 10 such as by welding to prevent any acid laden gas from escaping to the outside atmosphere. In addition, lining 11 within the interior of precipitator 10 is burned to conduit 23 to form an impervious joint therebetween. It should be emphasized that when using the alternate embodiment as shown in FIG. 2, end 27 of conduit 23 extends through support plate 14 and thus one or more collector electrode tubes 19 must be removed from the area of conduit 23 to insure that interference therebetween does not occur. However, since the removal of one or more collector electrode tubes 19 would decrease the efficiency of precipitator 10, precipitator 10 must be made so that the same number of collector electrode tubes 19 are placed within the interior of precipitator 10 as that used and shown in FIG. 1. In addition, although one gas conduit means 23 is shown in FIG. 2, two or more conduits may be used for directing the gas to the interior of precipitator 10.

Since the end 27 of conduit 23 is pointing downward, the flow of gas therethrough will flow downward to the bottom of precipitator 10 before dispersing throughout the interior of precipitator 10 just below support plate 14 causing an uneven distribution of gas. Thus, to insure that an even distribution of gas flows through the interior of precipitator 10 prior to entering the bottoms 78 and 82 of collector electrode tubes 19 and 21, an acid resistant conical cone 29 is secured to end 27 of conduit 23. Conical cone 29 is secured to end 27 of conduit 23 such as by burning when both conduit 23 and conical cone 29 are made of lead thus forming an impervious joint therebetween. A plurality of openings 31 extend through the conical surface of conical cone 29 thereby allowing the gas flowing into conical cone 29 to be discharged substantially horizontally through openings 31 in all directions within the interior of precipitator 10. In this manner, the acid laden gas is directed to all parts of the interior of precipitator 10 prior to falling to the bottom thereof thus insuring an even distribution of gas through collector electrode tubes 19 and 21.

Shell 22 further includes a gas outlet port 33 which is located above support plate 14 to accommodate the purified gas as it exits from the top of collector electrode tubes 19 and 21. Once the gas has been cleaned, the gas exits from shell 22 by gas outlet port 33 and is disposed of by any conventional means such as into a gas stack (not shown). Shell 22 further includes a hopper 40 (only a portion thereof shown) located at the bottom of precipitator 10. As the acidic elements are removed from the acid laden gas, droplets of acid are formed on the inside surface of tubes 19 and 21 which run down tubes 19 and 21, and drop into hopper 40 from which the acidic elements are collected and disposed of in the conventional manner.

At the top of shell 22 is an enclosed area 42. Housed within area 42 is an insulator 44 which is used to suspend top support grid 24, bottom guide grid 26, discharge electrodes 28, and discharge support member 30 within precipitator 10 (FIG. 1) and to insulate them from shell 22.

Referring now to FIGS. 1, 3, 5, and 9 support plate 14 is secured to the inner periphery of shell 22 such as by welding. Support plate 14 is preferably made from a steel plate 49 or any other material which is rigid and capable of supporting collector electrode tubes 19 and 21. Steel plate 49 has a plurality of opening with a diameter larger than the diameter of collector electrode tubes 19 and has a plurality of openings with a diameter larger than the diameter of collector electrode tubes 21. The configuration of the openings in plate 49 is substantially as shown in FIG. 2. Since precipitator 10 is to be used with acid laden gas, the acid particles are subject to contacting steel plate 49 and corroding it. Thus, to prevent the acid particles from attacking plate 49, the top surface of plate 49 is covered by a sheet 46 of acid resistant material such as lead and the bottom surface of plate 49 is covered with a sheet 47 of acid resistant material such as lead. Lead sheet 46 has the same hole pattern and diameter as the openings in plate 49. Lead sheet 47 has the same hole pattern which have a smaller diameter than plate 49. The excess portion 51 around each opening is bent upward to cover plate 49 and excess portion 51 of lead sheet 47 is burned to top lead sheet 46 to form an impervious joint therebetween to prevent acid particles from contacting plate 49 around the openings. Lead sheets 46 and 47 are then burned to lead lining 11 around shell 22 of precipitator 10 to make an impervious joint therebetween to prevent acid particles from penetrating between sheets 46 and 47 and lining 11 and attacking plate 49.

Referring to FIGS. 1, 3, 4, 5, 6, and 7, precipitator 10 utilizes two sets of collector electrode tubes for collecting the impurities in the acid laden gas. The first set 18 contains a plurality of tubular electrode 19 and the second set 20 contains a plurality of tubular electrodes 21. Both sets of collector electrode tubes 18 and 20 are preferably made of lead, however, any type of acid resistant material may be used. Collector electrode tubes 19 in first set 18 is preferably of the standard type having an inside diameter of substantially 10 inches. Collector electrode tube 21 in second set 20 is preferably of the standard type having an inside diameter of substantially 13 inches. The need for different diameter collector electrode tubes in precipitator 10 will become apparent when later described in connection with discharge electrodes 28 and 30.

Collector electrode tubes 19 and 21 are positioned in the openings in support plate 14 in the configuration illustrated in FIG. 3. As illustrated in FIG. 3, there are four collector electrode tubes 21 in second set 20 and the remainder is made up of collector electrode tubes 19 in first set 18. Although this is the preferred arrangement it should be understood, however, that the number of collector electrode tubes 19 and 21 may vary and still be within the scope of the present invention. To support each of the collector electrode tubes 19 and 21 on support plate 14, tops 48 and 50 of each collector electrode tube 19 and 21 respectively is flared and curled so that tops 48 and 50 rest upon top lead sheet 46 on plate 49 thus supporting and suspending each tube 19 and 21 within precipitator 10 (FIG. 5). The joint between tops 48 and 50 and top lead sheet 46 is burned to make an impervious joint therebetween.

Referring to FIGS. 1, 3, and 5, top grid 24 for supporting discharge electrode 28 and discharge support members 30 is supported by an acid resistant plate, denoted generally by numeral 54, spaced above the top of plate 14 and secured to shell 22 such as by welding. As shown in FIG. 9, acid resistant plate 54 comprises a support plate 57 which is preferably made of a rigid material such as steel. Since support plate 57 is preferably made of steel, it is subject to being attacked by corrosive elements in the acid laden gas and thus must be protected by a non-corrosive material. A top sheet of lead 55 is placed on the top surface of plate 57 and is burned to lining 11 surrounding shell 22 of precipitator 10 forming an impervious joint therebetween. In addition, a lead sheet 53 is placed on the bottom surface of plate 57 and is burned to lining 11 forming an impervious joint therebetween thus preventing any of he acid elements from contacting plate 57. Support plate 54 contains a pair of openings 59 spaced from one another and extending therethrough. Openings 59 are lined with an upturned portion of bottom lead sheets 53 which is burned to top lead sheet 55 (not shown) in a similar manner as previously explained for support plate 14. Thus, steel plate 57 is protected from the acidic elements of the acid laden gas. A pair of support rods 56 pass through insulators 44 and plates 54 through openings 59 without contacting plate 54 and are secured to insulators 44 by nuts 58. Insulators 44 insulate grid 24 from shell 22. Rods 56 extend downward to a position above support plate 14. A second pair of rods 60 are secured at substantially their center to the lower end of rod 56 such as by welding. A third pair of rods 62 are secured such as by welding on top of the pair of rods 60 and are spaced substantially at the ends of rods 60 so that rods 62 run perpendicular to rods 60 substantially to the opposite sides of shell 22. A plurality of various length rods 64 are spaced perpendicularly along rods 62 and secured thereto such as by welding. Each rod 64 is positioned so that it is substantially over the center of each row of collector electrode tubes 19 and 21 and substantially spans the length of each row of collector electrode tubes 19 and 21 as illustrated in FIG. 3.

Referring now to FIG. 5, since top grid 24 is to be used where it can be attacked by acidic elements of the acid laden gas, each of the rods 56, 60, 62 and 64 must be made of acid resistant material or preferably completely covered by a layer of lead 66. The layer of lead 66 is burned at the intersection of each of the rods to form an impervious joint so that the acid does not contact rods 56, 60, 62 and 64.

Referring again to FIG. 5, discharge wires 28 are suspended from rods 64 on top support grid 24 so that they extend through the center of each collector electrode tube 19 in first set 18. Discharge wires 28 include a top lead shroud 68. One end of shroud 68 is wrapped around rod 64, and secured to the body of shroud 68 by lead clamp 70. Shroud 68 is secured to rod 64 by burning shroud 68 to the lead covering 66 surrounding rod 64. Shroud 68 extends to the top portion of collector electrode tube 19. One end of a single lead discharge electrode wire 72 is secured to the end of shroud 68 such as by burning, and extends through the center of collector electrode tube 19 to a point substantially above the base of collector electrode tube 19. An end of a second lead shroud 74 is connected to the bottom end of wire 72 such as by burning and extends below tube 19 where it connects to bottom guide grid 26, to be explained later.

Preferably, discharge wire 72 is a single lead wire in the configuration of a star in cross section (FIG. 6). In this configuration, it has been found that there is exceptionally good electrical emission from each of the points 76 of star wire 72 thus producing a good electrostatic field within collector electrode tube 19. Although the lead star wire is preferred, other configurations can be used such as, for example, a nickel base alloy wire composed of the elements Ni, Co, Cr, Mo, Fe, Si, Mg. V, C, P, and S which is manufactured under the tradename Hastelloy and manufactured by Stellite Division, Cabot Corporation, Kokoma, Ind., a steel wire covered with lead, a barb wire with lead and the like.

Preferably, discharge electrode wire 72 extends from a point below top 48 of collector electrode tube 19 to a point just above bottom 78 of collector electrode tube 19. The reason is that it prevents arcing between discharge electrode wire 72 and top 48 and bottom 78 where the discharge electrode wire 72 enters and leaves the electrostatic field within collector electrode tube 19.

Referring again to FIG. 5, discharge support members 30 are suspended from rods 64 on top support grid 24 so they extend through the center of each collector electrode tube 21 in second set 20. Discharge support members 30 comprise an extension rod 80 whose one end is secured to rod 64 such as by welding and extends below rod 62. A tubular pipe 32 having an inside diameter substantially the same as the outside diameter of rod 80 is placed over rod 80 so rod 80 extends into pipe 32. Pipe 32 is secured to rod 80 such as by welding. Pipe 32 extends from a point above top 50 of collector electrode tube 21 to a point below bottom 82 of collector electrode tube 21.

An extruded lead sheath 84 (FIGS. 5, 7, and 8) having a plurality of striae 34 extending the length thereof and having an inside diameter substantially the same as the outside diameter of pipe 32 surrounds pipe 32. Sheath 84 extends from a point just below top 50 of collector electrode tube 21 to a point just above bottom 82 of collector electrode tube 21. A lead collar 86 is wrapped around pipe 32 from the top of lead sheath 84 to a point above top 50 of collector electrode tube 21 and a second lead collar 88 is tightly wrapped around pipe 32 from the bottom of sheath 84 to a point below bottom 82 of collector electrode tube 21. Collars 86 and 88 hold lead sheath 84 in position and protects pipe 32 from being contacted by the acid particles. A tubular extension 90 is secured to the lower end of pipe 32 such as by welding and extension 90 is secured to bottom guide grid 26, to be described later. A lead covering 92, shown as a dotted line in FIG. 5, which is wrapped around the top part of pipe 32 in rod 80 is burned at the junction between lead collar 86 and lead covering 92 and between lead cover 66 on pipe 64 and lead covering 92 to completely seal the non-corrosive resistant metals from being contacted by the acidic particles. Lead sheath 84 is preferably positioned within collected electrode tube 21 so that the top of lead sheath 84 is substantially below top 50 and the bottom of lead sheath 84 is substantially above bottom 82 of collector electrode tube 21 for the same reasons are previously set forth for discharge wire 72.

Referring now to FIG. 8, lead sheath 84 is preferably extruded by any conventional manner to form a plurality of circumferentially spaced peak projections 94 extending substantially the length of lead sheath 84 and forming striae 34 between each projection 94. Preferably, peak projections 94 are in the form of a triangle as illustrated in FIG. 8 with the apex 96 of the triangle radially extending toward collector electrode tube 21.

The triangular configuration is preferred because it has been found that exceptionally good emission for creating an electrostatic field is obtained from a point source such as apex 96 on each of the projections 94. In addition, since the electrical emission for each apex 96 is directed radially toward the inside surface of collector electrode tube 21, the radial emission will not conflict and tend to cancel the electrostatic field being produced. Although the preferred construction of peak projections 94 is triangular, it should be understood, however, that other configurations can also be used, such as, for example, rounded or domed protrusions, square protrusions, or rectangular protrusions. It has been found that the preferred included angle $\alpha$ of apex 96 of protrusion 94 is substantially 60° to obtain the most efficient electrostatic field; however, any angle between 1° and 179° may be used depending on the configuration desired. Although angle $\beta$ between adjacent protrusions 94 is preferred to be 30° any angular distance between protrusions may be used to satisfy the needs of the operation.

As illustrated in FIGS. 1, 3, 5, 6, and 7, collector electrode tubes 21 in second set 20 are of larger diameter than collector electrode tubes 19 in first set 18. In addition, the diameter of lead sheath 84 of discharge support member 30 is of greater diameter than discharge wire 72 of discharge electrode 28. The reason support member 30 is of greater diameter than discharge electrode 28, is that pipe 32 must be of such a diameter than will adequately support the bottom grid 26 and prevent discharge electrodes 28 from oscillating or swinging. It has been found that the outside diameter of piper 32 is preferably substantially 2⅜ inches to give the required support and electrostatic gap. Then by adding the lead sheath 84, the diameter of support member 30 is additionally increased. Should a conventional 10 inch diameter collector electrode tube 19 be used with support member 30, gap 98 (FIG. 6) between discharge wire 72 and the inside surface of collector electrode tube 19 would be greater than the gap between apex 96 of lead sheath 84 and the inside surface of collector electrode tube 19. With this arrangement it would take a lower voltage to cause an emission from protrusion 94 than it would from wire 72 with the result that support member 30 would control the voltage for all tubes in first set 18 which is lower than the required voltage and thus causing an inefficient corona discharge and thus insufficient precipitation. Therefore, conventional 13 inch diameter collector electrode tubes 21 are preferably used with support member 30 and lead sheath 84 is extruded to have a diameter that will produce a gap 100 (FIG. 7) between apex 96 and the inside surface of collector electrode tube 21 that is substantially the same as gap 98 (FIG. 6). Thus, the same voltage potential is required to create a good electrostatic field for maximum precipitation in both collector electrode tubes 19 and 21.

Although the above description has presented the preferred arrangement between discharge electrode 28 and collector electrode tube 19 and support member 30 and collector electrode tube 21, any diameter tube and discharge electrode may be used since the diameter of pipe 32 may vary depending on the amount of strength needed to adequately support bottom grid 26 and to prevent oscillation of discharge electrodes 28. The only requirement necessary for proper precipitation is that gaps 98 and 100 be substantially the same.

In addition, the preferred construction of support member 30 depicts pipe 32 having extruded sheath 84 with a plurality of striae 34 surrounding pipe 32. Although this is the preferred construction, other arrangements may be used such as, for example, pipe 32 may be made from a non-corrosive metal such as titanium, tantalum, or stainless steel, in which case pipe 32 is extruded to form the striae 34 directly on the surface of pipe 32, thus eliminating the need for lead sheath 84.

Referring now to FIG. 1, 4, and 5, bottom guide grid 26, which is used for preventing oscillation of discharge electrodes 28, comprises a pair of spaced rods 102 positioned below collector electrode tubes 19 and 21 and extending the length of each row of collector electrode tubes that contain collector electrode tubes 21. Rods 102 are positioned in vertical alignment with the row of tubes containing collector electrode tubes 21 as illustrated in FIGS. 3 and 4. Tubular extension 90 which is secured to the lower end of pipe 32 of each support member 30 is secured to rod 102 such as by welding. A second pair of rods 104 is positioned on top of rods 102 extending perpendicular to the length of rods 102 and positioned in board of extensions 90 as shown in FIG. 4. Rods 104 are secured to rods 102 such as by welding. A plurality of rods 106 are positioned on top of rods 104 extending perpendicular to the length of rods 104 and in vertical alignment with discharge wires 28 in each row of collector electrode tubes 19. The length of rods 106 will vary depending upon which row of tubes it is in alignment with. Referring to FIGS. 1 and 4, in a row of collector tubes containing both collector electrode tubes 19 and 21, rods 106 will not span the length of the row of collector electrode tubes 19 and 21 without interfering with support member 30 since support member 30 is also in that row. In each of these rows, rod 106 only spans a distance between support members 30 and an extension rod 108 is secured to extension 90 of support member 30 such as by welding and extends outwardly to a position beneath the outer most discharge wire 28. Rods 106 are secured to rods 104 such as by welding.

Since precipitator 10 is used to purify an acid laden gas, rods 102, 104, 106 and 108 are completely covered by a layer of lead 110 and all joints are burned to make the entire bottom guide grid 28 impervious to acid so the acid particles do not contact rods 102, 104, 106 and 108. In addition, a lead covering 112 shown as a dotted line in FIG. 4, extends from lead collar 88 and around pipe 32 and extension 90 to the lead covering 110 on rod 102. The joint between collar 88 and cover 112 and the joint between lead cover 110 on rod 102 and collar 88 is burned to make an impervious joint so the acid particles do not contact pipe 32 and extension 90.

Referring now to FIG. 5, discharge electrode wire 28 is restricted by bottom guide grid 26 as follows: the bottom end of shroud 74 is attached such as by burning, to a lead extension 114 having at one end a pair of spaced tongues 116 defining a space 118 therebetween. Extension 114 straddles rod 106 so that rod 106 is confined within space 118 between tongues 116. A pair of lead rods 120 are burned onto lead cover 110 of rod 106 on opposite sides of extension 114; thus discharge electrode 28 is prevented from moving side to side or from oscillating. Discharge electrode 28 is free to move up and down on rod 106 within space 118 to take up any slack that may occur due to stretching of discharge electrode 28, thus keeping discharge wire 72 tight and straight at all times.

Referring now to FIG. 9, which shows pressure relief means 148, the outside of precipitator 10 is subject to outside atmospheric pressure. Conventionally, the interior of precipitator 10 is kept at a lower pressure than the outside atmospheric pressure and is designated as negative pressure in FIG. 9. The negative pressure is present in the entire interior of precipitator 10 since there is not bottom plate as is in conventional tube type precipitators. It has been experienced in industry that when a pin hole 164 extends through shell 22, it allows atmospheric pressure to be exerted between shell 22 and lining 11 due to the atmosphere going through pin hole 164. This positive pressure being exerted on lead lining 11 by the atmosphere causes lead lining 11 to be formed away from shell 22 toward the interior of precipitator 10. Eventually, the atmospheric pressure causes lead lining 11 to rupture causing the outside atmosphere to enter the interior of precipitator 10 and cause the acidic elements to escape through the rupture in lining 11 and attack the non-corrosive resistant metals that make up shell 22 and other parts of precipitator 10 and also to escape to the atmosphere.

To prevent the atmosphere from being introduced between shell 22 and lead lining 11 causing a positive pressure on lining 11 a pressure relief means 148 is installed on the outside of shell 22. Pressure relief means 148 includes a conical opening 150 formed in shell 22 and extends through shell 22 to lead lining 11. An enclosure 152 surrounds conical opening 150 and is secured to shell 22 such as by welding to form an impervious joint therebetween. A conduit 154 extends through enclosure 152 and is secured at one end 156 to enclosure 152. A second end 158 of conduit 154 extends into the space within precipitator 10 between support plate 14 and support plate 54. Shell 22 and lining 11 contain openings 160 and 162 respectively therethrough substantially at the same diameter as end 158 of conduit 154. End 158 of conduit 154 extends through openings 160 and 162 into the interior of precipitator 10 between support plates 14 and 54. Since pressure relief means 148 extends into the interior of precipitator 10 it will be subject to attack by acidic particles and the refore must be made out of a non-corrosive material such as lead. End 158 of conduit 154 is burned to lead lining 11 surrounding the interior of precipitator 10 to form an impervious joint therebetween so that none of the acidic particles or acid laden gas escapes to the outside atmosphere or contact shell 22. Should a pin hole 164 develop in shell 22, the atmosphere entering through pin hole 164 will be routed through the pressure relief system since it is at a negative pressure to the space between support plate 14 and support plate 54 and will exit through outlet port 33, thus maintaining a negative pressure between shell 22 and lining 11.

Since enclosure 152 surrounds shell 22 which is made from steel or other noncorrosive resistant metal, the acid particles may pass back through conduit 154 from between plates 14 and 54 and into enclosure 152 and attack shell 22. To prevent this back flow of the acid laden gas through conduit 154, a small amount of atmosphere is allowed to enter enclosure 152 at all times. Since pressure relief means 148 is maintained at a negative pressure, this small amount of atmosphere will continuously flow from enclosure 152, through conduit 154 and into the interior of precipitator 10 between plates 14 and 54. This continuous flow of atmosphere prevents the acid laden gas from entering conduit 154 and attacking shell 22.

The small amount of atmosphere is introduced into enclosure 152 from a conventional pipe 166 having one end 168 that extends into enclosure 154. End 168 is secured to enclosure 152 such as by welding. The other end 170 of pipe 166 is open to atmosphere. Pipe 166 further includes a constricted area 172 that limits the amount of atmosphere that can flow through pipe 166 into enclosure 152. Preferably, constricted area 172 is made so that only one or two cubic feet of atmosphere per minute is allowed to flow into enclosure 152. Although the above is the preferred rate of flow, any flow rate can be maintained to suit the design and function of the individual precipitator.

In operation, and referring to FIG. 1, an acid laden gas is directed into electrostatic precipitator 10 through gas inlet port 16 which is located above the bottoms 78 and 82 of collector electrode tubes 19 and 21 respectively and below support plate 14. As the gas enters the interior of precipitator 10, it evenly distributes itself throughout the interior or precipitator 10 directly below support plate 14. The gas then moves downward in an even distribution throughout the interior of precipitator 10 until it reaches the bottoms 78 and 82 of collector electrode tubes 19 and 21. The acid laden gas is then directed upward through collector electrode tubes 19 and 21.

Referring to FIG. 2, which shows the alternate embodiment for evenly distributing the acid laden gas through the interior of precipitator 10 prior to entering bottoms 78 and 82 of collector electrode tubes 19 and 21, the acid laden gas flows through conduit 23, and enters the interior of precipitator 10 below support plate 14 through end 27 of conduit 23. As the acid laden gas passes through end 27 of conduit 23, it enters conical cone 29. The acid laden gas then flows substantially horizontally through openings 31 in conical cone 29 in all directions within the interior of precipitator 10. The gas evenly distributes itself through the interior of precipitator 10 immediately below support plate 14. The acid laden gas then flows downward until it is below the bottoms 78 and 82 of the collector electrode tubes 19 and 21. At this point, the acid laden gas is evenly distributed below collector electrode tubes 19 and 21. In this manner, the same concentration of gas will flow upward through each of the collector electrode tubes 19 and 21.

As the acid laden gas enters the bottoms 78 and 82 of collector electrode tubes 19 and 21, discharge electrode 28 and discharge support members 30 are energized by a conventional precipitator control system which causes an electrostatic field to be created around discharge wires 72 and lead sheath 84 and consequently in the interior cavity of collector electrode tubes 19 and 21. Since gap 98 between discharge wires 72 and the inside surface of collector electrode tubes 19 is substantially the same as gap 100 between apex 96 of peak projection 94 on sheath 84 and the inside surface of collector electrode tube 21 the voltage required to produce a good electrostatic field from apex 96 and discharge wires 72 will be substantially the same, thus producing a strong electrostatic field within both collector electrode tubes 19 and 21.

As the acid laden gas flows through collector electrode tubes 19 and 21, the electrostatic field around discharge wire 72 and lead sheath 84 ionizes the acidic elements. After ionization of the acidic elements, they are attracted to the inside surface of collector electrode tubes 19 and 21 and are collected thereon forming droplets of acidic elements.

The droplets of acid are removed from the inside surface of collector electrode tubes 19 and 21 by running down the inside surface until the acidic droplets drop off the bottoms 78 and 82 of collector electrode tubes 19 and 21 respectively and into hopper 40 where the acidic elements are disposed of outside the precipitator system.

When the gas exits the top of collector electrode tubes 19 and 21, it will be substantially free of all acidic elements. When the gas exits from collector electrode tubes 19 and 21, it is directed to exit port 33 located above top support plate 14 and below support plate 54. The gas will exit through port 33 since plate 14 prevents the clean gas from flowing downward and mixing with the acid laden gas around the outside surface of collector electrode tubes 19 and 21. From exit port 33 the gas is directed into any conventional disposal system, such as, for example, a gas stack.

Referring to FIG. 9, should a pin hole 164 develop through shell 22, the atmospheric pressure of the atmosphere on the outside of shell 22 will cause the atmosphere to flow through pin hole 164 into the space between shell 22 and lead lining 11. However, the negative pressure within the precipitator 10 and particularly that portion between support plates 14 and 54 causes a vacuum or negative pressure within conduit 154, enclosure 152, and conical opening 150. Thus, the positive pressure created by the atmosphere will not remain between shell 22 and lining 11 because the atmosphere will flow through conical opening 150, into enclosure 152, through conduit 154, upward through end 158, and into the negative pressure chamber between support plates 14 and 54. The atmosphere will then flow out through outlet port 33 with the clean gas exiting therethrough. By maintaining negative pressure in conduit 154, the positive pressure will be eliminated from pushing lining 11 away from shell 22 and possibly rupturing lining 11.

The foregoing has presented a novel electrostatic precipitator for removal of corrosive particles from a corrosive particle laden gas passing therethrough. The problem of having a few of the collector electrode tubes and associated discharge electrodes control the voltage required in all the collector electrode tubes has been eliminated by maintaining the gap between the discharge electrode and the inside surface of the first set of collector tubes the same as the gap between the discharge support members and the inside surface of the second set of collector electrode tubes. The problem of poor electrical emission from the discharge support member has been essentially eliminated by providing the surface of the support member with a plurality of peak projections forming striae therebetween which extend the length thereof so that the electrical emission is emitted radially from a point source. The problem of uneven distribution of gas flowing through the collector electrode tubes which causes inefficient precipitation in some tubes has been eliminated by introducing the acid laden gas through an inlet port which is close to the collector electrode tube support plate so the gas will evenly distribute itself through the interior of the precipitator prior to entering the bottom of the collector electrode tubes. The problem of having the lead lining within the interior of the shell rupture or pull away from the shell by the introduction of the atmosphere through a pin hole in the shell between the shell and lining has been eliminated by the use of a pressure relief means which maintains a negative pressure between the shell and the lining. The problem of collector electrode tube collapse has been eliminated by the removal of the bottom plate thereby maintaining the same pressure inside and outside the collector electrode tubes.

Accordingly, the invention having been described in its best embodiment and mode of operation that which is to be claimed by Letters Patent is:

1. An improved electrostatic precipitator for removal of corrosive particles from a corrosive particle laden gas passing therethrough comprising:

a shell having a corrosive resistant lining secured thereto;

a corrosive resistant support plate secured to said shell of said precipitator;

first and second sets of juxtaposed corrosive resistant collector electrode tubes suspended from said support plate, said collector tubes of said second set being of larger diameter than those of said first set;

a corrosive resistant top support grid spaced above said support plate and insulated from said shell;

a corrosive resistant bottom guide grid spaced below said first and second sets of collector electrode tubes;

corrosive resistant discharge wires secured to said top support grid and said bottom guide grid and passing through the center of each collector electrode tube in said first set;

corrosive resistant discharge support members secured to said top support grid and said bottom guide grid and passing through the center of each collector electrode tube in said second set for supporting said bottom grid;

inlet port means for supplying said corrosive particle laden gas to the interior of said precipitator; and outlet port means for removing the treated gas from said precipitator;

wherein the improvement comprises:

including in said electrostatic precipitator a pressure relief means having a one end connected between said shell and said lining below said support plate and having another end connected to the interior of said precipitator above said support plate for maintaining negative atmosphere pressure between said shell and said lining to prevent positive pressure between said shell and lining thereby maintaining said lining against said shell said pressure relief means being corrosive resistant.

2. An electrostatic precipitator as in claim 1 wherein said inlet port means extends through said shell above the bottom of said first and second sets of collector electrode tubes for insuring a substantially even distribution of said particle laden gas throughout the entire interior of said precipitator below said support plate prior to said gas entering the bottom of any of said collector tubes.

3. An electrostatic precipitator as in claim 2 wherein said discharge support members comprise a pipe member covered by a lead sheath having a plurality of circumferentially spaced peaked projections extending substantially the length of said lead sheath wherein the radial distance between the peaks of said projections and the inner surface of the collector electrode tubes of said second set is substantially the same as the radial distance between the outer surface of the discharge wires and the inner surface of the collector tubes of said first set so as to maintain a substantially uniform electrostatic field within all of said collector tubes.

4. An electrostatic precipitator as in claim 1 wherein said inlet port means comprises a conduit means extending through the top of said shell and through said support plate for insuring a substantially even distribution of said particle laden gas throughout the entire interior of said precipitator below said support plate prior to said gas entering the bottom of any of said collector tubes.

5. An electrostatic precipitator as in claim 4 wherein said discharge support members comprise a pipe member covered by a lead sheath having a plurality of circumferentially spaced peaked projections extending substantially the length of said lead sheath wherein the radial distance between the peaks of said projections and the inner surface of the collector electrode tubes of said second set is substantially the same as the radial distance between the outer surface of the discharge wires and the inner surface of the collector tubes of said first set so as to maintain a substantially uniform electrostatic field within all of said collector tubes.

6. An electrostatic precipitator as in claim 1 wherein said discharge support members comprise a pipe covered by a lead sheath having a plurality of circumferentially spaced peaked projections extending substantially the length of said lead sheath wherein the radial distance between the peaks of said projections and the inner surface of the collector electrode tubes of said second set is substantially the same as the radial distance between the outer surface of the discharge wires and the inner surface of the collector tubes of said first set so as to maintain a substantially uniform electrostatic field within all of said collector tubes.

* * * * *

UNITED STATES PATENT OFFICE

CERTIFICATE OF CORRECTION

PATENT NO. : 4,042,354

DATED : August 16, 1977

INVENTOR(S) : William H. Tully

It is certified that error appears in the above-identified patent and that said Letters Patent are hereby corrected as shown below:

| | |
|---|---|
| Column 9, Line 48 | 'he' should be --the-- |
| Column 13, Line 9 | '28' should be --26-- |
| Column 13, Line 46 | 'formed' should be --forced-- |
| Column 14, Line 52 | 'or' should be --of-- |
| Claim 6, Line 2 | 'a pipe cov-' should be --a pipe member cov- -- |

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*